US006962187B2

(12) United States Patent
Gilmore et al.

(10) Patent No.: US 6,962,187 B2
(45) Date of Patent: Nov. 8, 2005

(54) SPOOLS FOR HORIZONTAL BLINDS

(75) Inventors: Kenneth L. Gilmore, Chatsworth, CA (US); Craig A. Robinson, Phoenix, AZ (US)

(73) Assignee: Gilmore Enterprises, Chatsworth, CA (US)

( * ) Notice: Subject to any disclaimer, the term of this patent is extended or adjusted under 35 U.S.C. 154(b) by 0 days.

(21) Appl. No.: 10/316,238

(22) Filed: Dec. 9, 2002

(65) Prior Publication Data

US 2004/0108079 A1 Jun. 10, 2004

(51) Int. Cl.[7] ..... E06B 9/30

(52) U.S. Cl. ..... 160/170 R; 160/171 R; 160/173 R

(58) Field of Search ..... 160/84.04, 168.1 R, 160/171 R, 173 R, 170 R, 178.1 R

(56) References Cited

U.S. PATENT DOCUMENTS

| | | | | |
|---|---|---|---|---|
| 1,819,337 A | | 8/1931 | Pevear | |
| 2,349,118 A | * | 5/1944 | Simpson | 74/393 |
| 2,598,887 A | * | 6/1952 | Burns | 160/170 |
| 3,176,932 A | | 4/1965 | Kovaleski | |
| 3,296,583 A | * | 1/1967 | Chatten et al. | 367/141 |
| 3,756,585 A | | 9/1973 | Mihalcheon | |
| 3,857,529 A | * | 12/1974 | Pitts et al. | 242/118.3 |
| 3,958,769 A | * | 5/1976 | Miyamae | 242/318 |
| 4,088,170 A | * | 5/1978 | Franklin | 160/84.01 |
| 4,176,807 A | * | 12/1979 | Kwon | 242/394 |
| 5,054,162 A | | 10/1991 | Rogers | |
| 5,133,399 A | | 7/1992 | Hiller et al. | |
| 5,374,007 A | * | 12/1994 | Murison | 242/538.2 |
| 5,482,100 A | | 1/1996 | Kuhar | |
| 5,531,257 A | | 7/1996 | Kuhar | |
| 5,799,715 A | | 9/1998 | Biro et al. | |
| 5,996,667 A | * | 12/1999 | Fun | 160/84.01 |
| 6,102,195 A | * | 8/2000 | Weikel | 198/808 |
| 6,155,328 A | | 12/2000 | Welfonder | |
| 6,244,532 B1 | * | 6/2001 | Watanabe | 242/399.1 |
| 6,283,192 B1 | * | 9/2001 | Toti | 160/170 |
| 6,289,965 B1 | | 9/2001 | Ruggles | |
| 6,318,661 B1 | * | 11/2001 | Martin et al. | 242/373 |
| 6,325,131 B1 | * | 12/2001 | Dekker et al. | 160/170 |
| 6,330,899 B1 | * | 12/2001 | Ciuca et al. | 160/170 |
| 6,561,253 B1 | * | 5/2003 | Hsiao | 160/177 R |
| 6,588,480 B2 | | 7/2003 | Anderson | |
| 6,622,769 B2 | * | 9/2003 | Judkins | 160/84.05 |
| 6,808,002 B2 | * | 10/2004 | Colson et al. | 160/176.1 R |

FOREIGN PATENT DOCUMENTS

| | | |
|---|---|---|
| DE | 40 01 250 A1 | 7/1991 |
| EP | 1 013 871 A1 | 6/2000 |
| EP | 1 045 109 A1 | 10/2000 |

* cited by examiner

*Primary Examiner*—Bruce A. Lev
(74) *Attorney, Agent, or Firm*—Knobbe, Martens, Olson & Bear, LLP

(57) ABSTRACT

The present spools are shaped as flared cylinders. In one embodiment, the spools have a minimum circumference at a center, and maximum circumferences at outer portions thereof. In another embodiment, the spools flare from a maximum diameter adjacent a first side wall to a minimum diameter adjacent a second side wall. In another embodiment, the spools taper from large diameters adjacent first and second side walls to a minimum diameter at a point between the side walls, wherein the point is offset from a midpoint between the side walls. In another embodiment, the spools are subdivided by at least one partition.

11 Claims, 12 Drawing Sheets

SPOOLS FOR HORIZONTAL BLINDS

BACKGROUND OF THE INVENTION

1. Field of the Invention

The present invention relates to window coverings. More particularly, the present spools for horizontal blinds provide an apparatus for winding up multiple lift cords inside a head rail using only one pull cord, wherein the spools reduce the likelihood of the lift cords becoming tangled.

2. Description of the Related Art

Conventional horizontal blinds comprise a plurality of horizontal slats that are raised, lowered and/or rotated to adjust a level of light entering a room through a window or door. The slats are supported from a head rail by ladders. Generally, the blind assembly includes at least two ladders, and may include more ladders depending upon the length or weight of the slats.

Each ladder is typically constructed of a strong fibrous material such as nylon, and comprises a pair of vertically extending uprights supporting a plurality of evenly spaced rungs. An upper end of each upright is secured to a tilting mechanism within the head rail. Lower ends of each upright are secured to a bottom rail. Each rung supports a slat.

The tilting mechanism may comprise an elongate rod having a length substantially equal to a length of the head rail. The rod includes a plurality of attached drums, one drum corresponding to each ladder. Upper ends of the ladder uprights are secured to the drums. A wand or cord descending from the head rail controls rotation of the rod. The drums rotate with the rod, and the ladder uprights follow the rotation of the drums. As the drums rotate in a first direction, the ladder uprights on one side of the slats rise, and the ladder uprights on the opposite side of the slats fall, thus tilting the slats in a first tilt direction. As the drums rotate in a second direction opposite the first direction, the slats tilt in a second tilt direction.

Lifting cords descend from the head rail and are attached at their lower ends to the bottom rail. Generally, a position of each lifting cord along the length of the slats corresponds to a position of a ladder. The lifting cords may be threaded through loops on the ladder uprights, descending along front and back edges of each slat. Alternatively, the lifting cords may pass through apertures in the center of each slat.

The upper end of each lifting cord passes over a pulley within the head rail and attaches to a spool. Preferably, each lifting cord has a unique spool to prevent entanglement of the lifting cords. Generally, each spool includes a portion for winding up a pull cord. The pull cord is connected at its upper end to the spool. The pull cords pass along the head rail to an opening in a lower surface of the head rail. All pull cords pass through this opening and hang freely from the head rail. Free ends of each pull cord are usually secured to one another.

A downward force on the pull cords rotates the spools, unwinding the pull cords from the spools and winding up the lifting cords onto the spools. As the lifting cords wind up, they raise the bottom rail, which in turn raises each successive slat. When the pull cords are released, gravity pulls the bottom rail downward, winding up the pull cords onto the spools, unwinding the lifting cords from the spools, and lowering the bottom rail and slats. A brake positioned within the head rail engages the pull cords at a user's direction. The brake enables the user to selectively control a height of the bottom rail.

Multiple pull cords hanging from the head rail present a strangulation hazard to children. When the blinds are raised, the pull cords descend and often hang such that their lower ends are close to the floor. These dangling cords are attractive to children, and children frequently play with the cords. Unfortunately, these children also frequently become entangled in the cords. Sometimes the cords wrap around a child's neck, the child's airway becomes constricted, and the child dies.

Horizontal blinds having only one pull cord are much safer for children. Although the single dangling pull cord is still an attractive plaything to children, the single cord is much less likely to become wrapped around a child's neck and cause strangulation. Therefore, recent horizontal blind designs include only one pull cord. For example, U.S. Pat. No. 5,799,715 to Biro et al. discloses a Venetian blind assembly 10 including a number of conventional horizontal slats 12. A mechanism within a housing 14 extending across the top of the assembly raises and tilts the slats. Specifically, a pair of lifting cords 16 extend downward from the housing. Each lifting cord extends through a slot 18 in each slat, and through a hole 20 in a bottom rail 22, to a knot 24 at its distal end. The proximal end of each lifting cord extends around a lower surface of a spool 26, into a cord receiving hole 28 through part of a section 30 of the spool. In this way, the lifting cords 16 are simultaneously wound or unwound on the spool with rotation of the spool.

The spool rotates in response to motion of a pull cord 32, which extends from the lower surface of the spool opposite the direction in which the lifting cords extend. Thus, pulling the pull cord downward causes the pull cord to be unwound from the spool as the lifting cords are wound onto the spool. As the lifting cords wind onto the spool, the bottom rail rises. Similarly, releasing the pull cord causes the bottom rail to descend under the influence of gravity. As the bottom rail descends, the pull cord winds onto the spool and the lifting cords unwind from the spool. A conventional braking mechanism 34 releasably engages the pull cord, enabling the bottom rail to be suspended at any point in its vertical travel.

Means are also provided for guiding up to four lifting cords into and out of four sections of the spool. To prevent tangling of the lifting cords with one another, each section winds up only one lifting cord. Thus, the sections are separated from one another, and from a section 64, on which the pull cord is wound, by intervening flanges 66. A guiding structure 68 provides five channels 70 to direct the passage of the lifting cords through a flange 72 of a spool bracket 62. Each channel 70, being in a proximate relationship with an associated spool section, aligns a lifting cord with the section on which it is wound. Feeding each lifting cord centrally onto a spool section eliminates a tendency of the cord to build up windings along a flange.

The lifting cords of the Venetian blind assembly of Biro tend to bunch up on the lifting cord spool. The cords do not wind up in a predictable manner, but rather wind up in a random haphazard way. As a result, each cord tends to become tangled with itself. When the cords become tangled, they prevent the bottom rail from raising and lowering smoothly. To untangle the cords, a user must disassemble the head rail, which is a time consuming process.

The configuration of Biro also limits the capacity of each lifting cord spool section to accept lifting cords. As the width of each section increases, so does its capacity to accept lifting cords. However, the lifting cord spool sections of Biro are all mounted side-by-side and coaxially on a single spool. Thus, the maximum width of each section, and each section's lifting cord capacity is limited by the front-to-back width of the housing.

Therefore, new spools for horizontal blinds that reduce any tendency of the lifting cords to become tangled, and that increase the lifting cord capacity of the spools, would be of great benefit to users of horizontal blinds.

SUMMARY OF THE INVENTION

The preferred embodiments of the present spools for horizontal blinds have several features, no single one of which is solely responsible for their desirable attributes. Without limiting the scope of these spools for horizontal blinds as expressed by the claims that follow, their more prominent features will now be discussed briefly. After considering this discussion, and particularly after reading the section entitled "Detailed Description of the Preferred Embodiments," one will understand how the features of the preferred embodiments provide advantages, which include reduced tendency for the lifting cords to become entangled and interfere with smooth operation of the blinds.

A preferred embodiment of the present spools for horizontal blinds comprises first and second spaced substantially disk-shaped walls, and a flared cylinder spanning the space between the walls. The cylinder includes a minimum circumference at substantially a center thereof, as measured along a longitudinal axis thereof. The cylinder further includes maximum circumferences at portions thereof that adjoin the walls.

Another preferred embodiment of the present spools for horizontal blinds comprises a substantially cylindrical bobbin including a plurality of substantially disk-shaped partitions. The partitions subdivide the bobbin into at least two sections. Each section is shaped as a flared cylinder, the cylinder having a minimum circumference at a midpoint between the partitions, and maximum circumferences at portions thereof adjoining the partitions.

Another preferred embodiment of the present spools for horizontal blinds comprises a first rotatably supported substantially cylindrical bobbin. The bobbin includes partitions subdividing the bobbin into a plurality of lifting cord spools. The spools further comprise a rotatably supported substantially cylindrical pull cord spool adjacent the first bobbin. Each lifting cord spool is shaped as a flared cylinder, the cylinder having a minimum circumference at a midpoint between the partitions, and maximum circumferences at portions thereof adjoining the partitions.

Another preferred embodiment of the present spools for horizontal blinds comprises a horizontal blind assembly. The assembly includes a head rail, and a horizontal bottom rail suspended from the head rail. A plurality of horizontal slats are suspended from the head rail intermediate the bottom rail and the head rail. At least one lifting cord descends from the head rail and is secured at a distal end to the bottom rail. A spool for winding the at least one lifting cord is located within the head rail. The spool comprises a flared cylindrical portion sandwiched between spaced disk-shaped walls. The cylindrical portion includes a minimum circumference at a midpoint between the walls, and maximum circumferences at portions thereof adjoining the walls.

BRIEF DESCRIPTION OF THE DRAWINGS

The preferred embodiments of the spools for horizontal blinds, illustrating their features, will now be discussed in detail. These embodiments depict the novel and non-obvious spools for horizontal blinds shown in the accompanying drawings, which are for illustrative purposes only. These drawings include the following figures, in which like numerals indicate like parts.

DETAILED DESCRIPTION OF THE PREFERRED EMBODIMENTS

Figure 1:
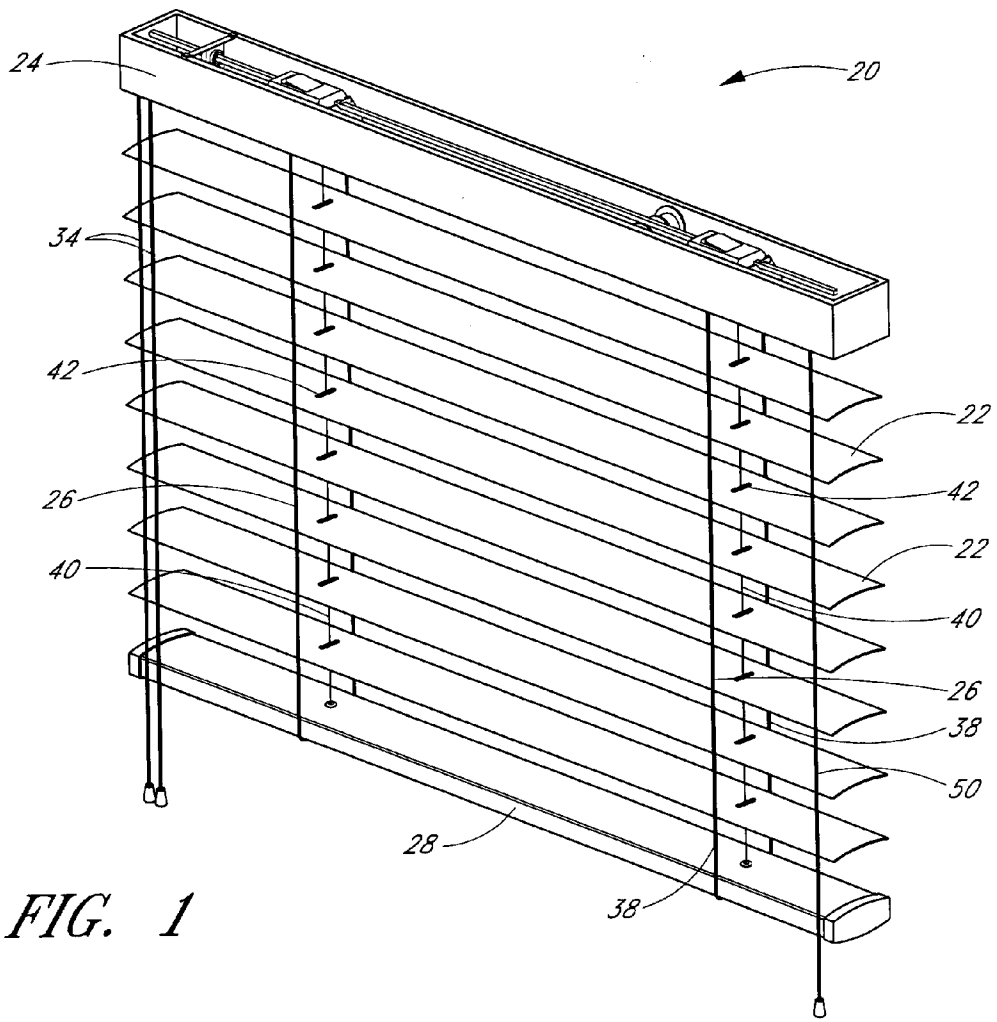
FIG. 1 is a front perspective view of a horizontal blind assembly adapted for use with the present spools for horizontal blinds.

FIG. 1 illustrates a horizontal blind assembly 20 adapted to include preferred embodiments of the present spools for horizontal blinds. The blinds comprise a plurality of horizontal slats 22 supported from a head rail 24 by ladders 26. Each ladder comprises first and second uprights 38. One upright 38 is positioned on a front side of the assembly 20, and the other upright 38 is positioned on a back side of the assembly 20. Lower ends of each ladder 26 are secured to a bottom rail 28. The illustrated blind assembly 20 includes two ladders 26. However, those of skill in the art will appreciate that the blind assembly 20 may include more ladders 26 depending upon the length and weight of the slats 22.

Figure 2:
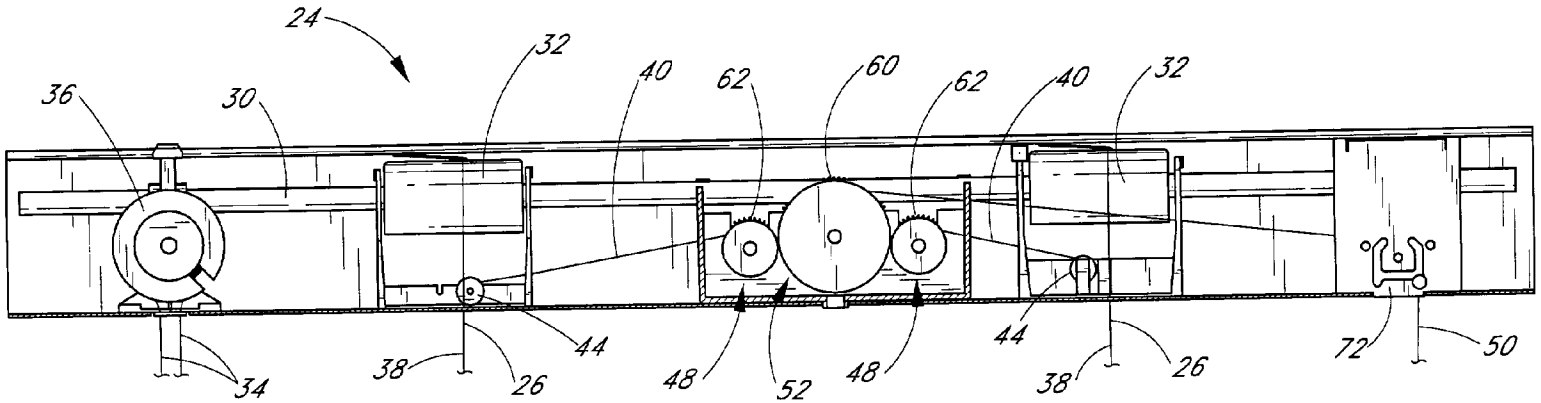
FIG. 2 is a front elevational, partial section view of a head rail including the present spools for horizontal blinds.

As illustrated in FIG. 2, an upper end of each upright 38 is secured to a tilting mechanism within the head rail 24. Those of skill in the art will appreciate that the illustrated tilting mechanism is merely exemplary. A variety of other well known tilting mechanisms could be used instead of that shown. The tilting mechanism comprises an elongate rod 30 with two attached drums 32. Each ladder 26 is fastened to a separate drum 32, and if more ladders 26 are provided, then an additional drum 32 would also be provided for each ladder 26. Each drum 32 preferably includes a central passage (not shown) through which the rod 30 passes. The drums 32 rotate with the rod 30. For example, the rod 30 may include a non-circular outer cross-section, and the central passage of each drum 32 may include a non-circular inner cross-section. Alternatively, an adhesive may secure the rod 30 within the inner passages of the drums 32.

A pair of tilt cords 34 (FIGS. 1 and 2) descend from a pulley 36 in the head rail 24. The tilt cords 34 are wrapped around the pulley 36 in opposite directions. Thus, as a user pulls one tilt cord 34, it unwraps from the pulley 36, and the rotation of the pulley 36 causes the other tilt cord 34 to wind onto the pulley 36. Through a system of gears (not shown), the rotating pulley 36 rotates the rod 30, which rotates the drums 32. The uprights 38 of each ladder 26 are secured to the drums 32, one upright 38 on each of the front and back sides of each drum 32. Therefore, as the drums 32 rotate in a first direction, the ladder uprights 38 on the front side of the drums 32 rise, and the ladder uprights 38 on the back side of the drums 32 fall. As the uprights 38 on the front side of the drums 32 rise and the uprights 38 on the back side of the drums 32 fall, the ladder rungs (not shown) tilt. Because the rungs support the slats 22, the slats 22 tilt along with the rungs.

Lifting cords 40 descend from the head rail 24 and are attached at their lower ends to the bottom rail 28. Generally, a position of each lifting cord 40 along the length of the slats 22 corresponds to a position of a ladder 26. The lifting cords 40 may be threaded through loops (not shown) on the ladder uprights 38, descending along front and/or back edges of each slat 22. Alternatively, the lifting cords 40 may pass through apertures 42 in the center of each slat 22, as shown in FIG. 1.

The lifting cords 40 may be any type of cord typically used in the window covering industry. One preferred type of cord is 0.9 mm Spectra-Fiber™. Those of skill in the art will appreciate, however, that any type of cord could be used, including other sizes of Spectra-Fiber™. Those of skill in the art will further appreciate that ribbons could also be used in place of cords.

Figure 3:
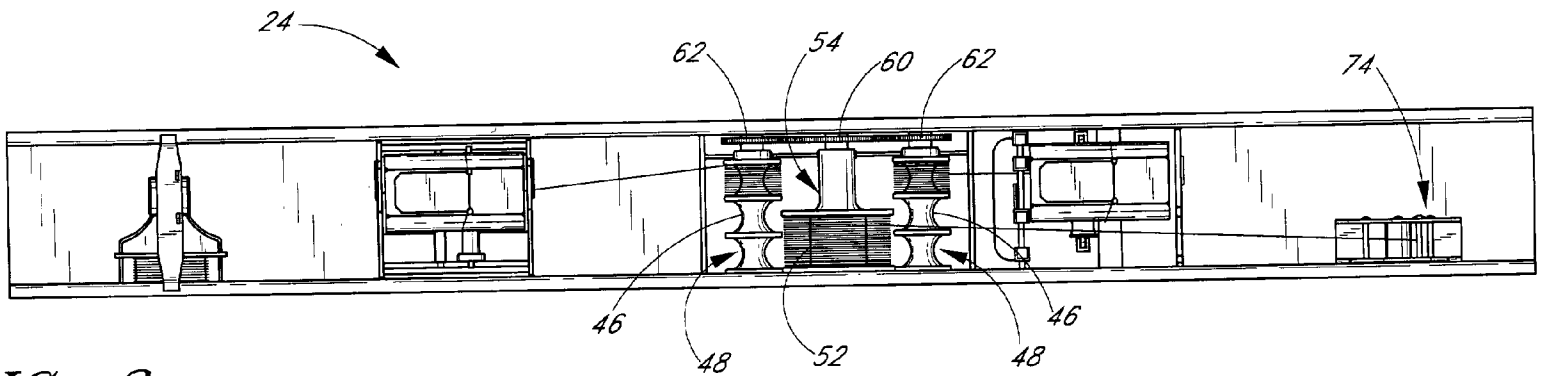
FIG. 3 is a top plan view of the head rail of FIG. 1, illustrating one preferred arrangement for the present spools for horizontal blinds.
Figure 4:
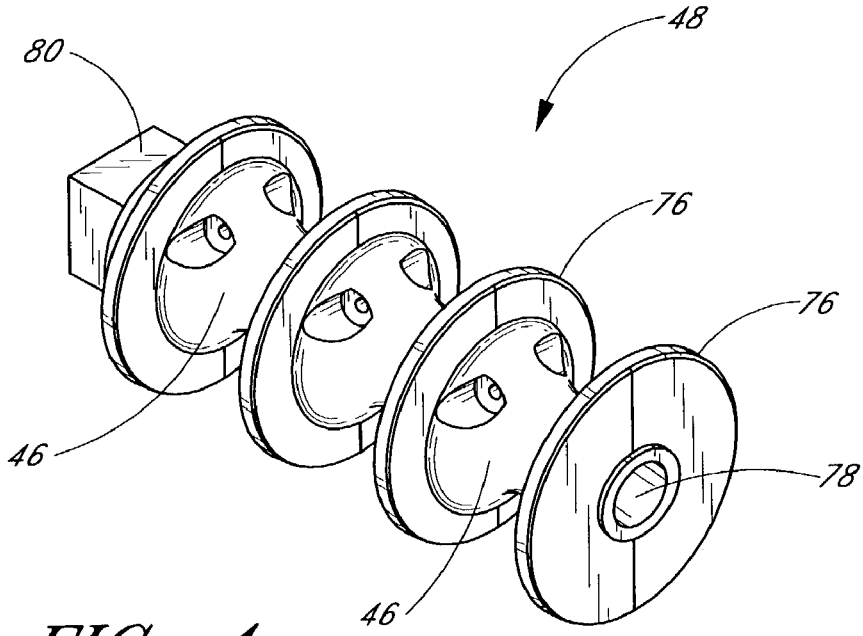
FIG. 4 is a perspective view of a lifting cord bobbin including the present spools for horizontal blinds.
Figure 5:
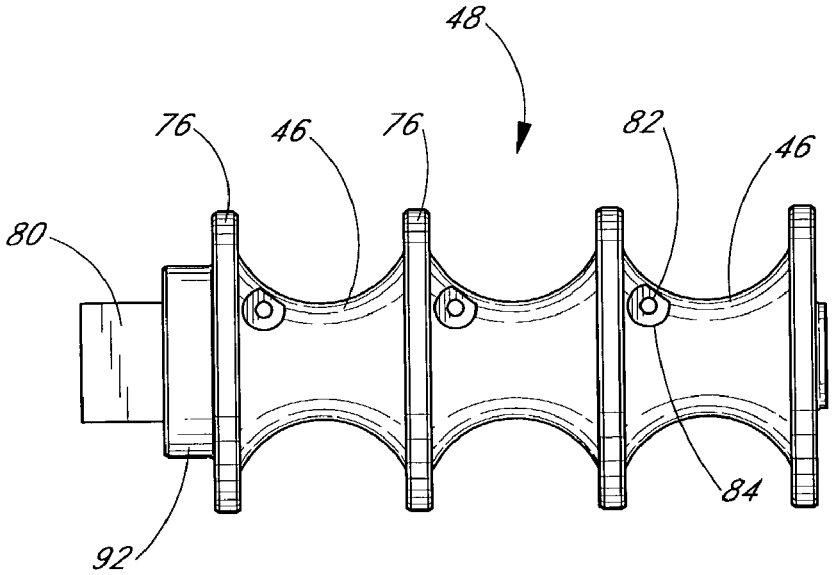
FIG. 5 is a front elevational view of the lifting cord bobbin of FIG. 4.

The upper end of each lifting cord 40 passes over a pulley 44 (FIG. 2) within the head rail 24 and winds onto a lifting cord spool 46 (FIGS. 3–5). Preferably, each lifting cord 40 winds onto its own spool 46 so that the lifting cords 40 do not become entangled with one another. In the illustrated embodiment, the lifting cord spools 46 comprise adjacent segments of a partitioned bobbin 48. In the illustrated embodiment, two spaced bobbins 48 are provided, and each bobbin 48 is partitioned into three spools 46, thus providing six lifting cord spools 46. For horizontal blinds assemblies having very long slats 22, each of the six lifting cord spools 46 would likely accommodate a lifting cord 40. For shorter and lighter slats 22, however, only select lifting cord spools 46 would be used to accommodate lifting cords 40. The remaining spools 46 would be unused.

The upper end of a pull cord 50 (FIGS. 1 and 2) winds onto a pull cord spool 52 (FIGS. 6 and 7) within the head rail 24. In the illustrated embodiment, the pull cord spool 52 comprises a partitioned segment of a stepped cylinder 54. A first narrow portion 56 of the pull cord cylinder 54 includes a substantially square peg 58 extending from an end thereof. A center of the peg 58 lies on the longitudinal axis of the pull cord cylinder 54. The peg 58 engages a substantially square aperture (not shown) in a center of a circular gear 60 (FIG. 3). The gear 60 thus rotates with the pull cord spool 52.

The pull cord 50 may be any type of cord typically used in the window covering industry. One preferred type of cord is 1.8 mm Spectra-Fiber™. Those of skill in the art will appreciate, however, that any type of cord could be used, including other sizes of Spectra-Fiber™. Those of skill in the art will further appreciate that ribbons could also be used in place of cords.

As shown in FIGS. 2 and 3, the pull cord cylinder 54 is parallel to and located between the lifting cord spool bobbins 48. The pull cord cylinder gear 60 intermeshes with a circular gear 62 at a first end of each lifting cord bobbin 48. Thus, rotation of the pull cord cylinder 54 induces rotation of the lifting cord bobbins 48.

Figure 19:
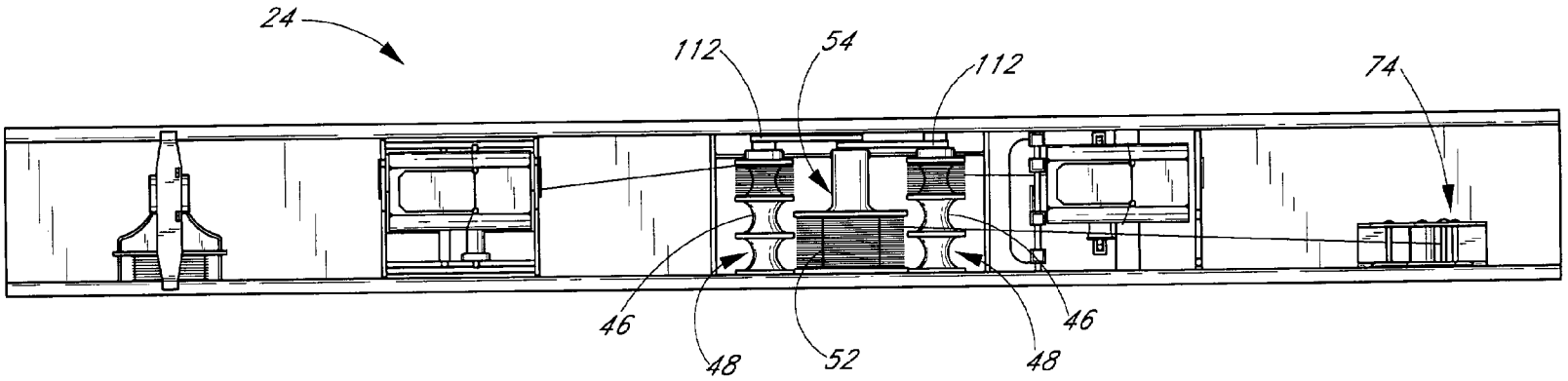
FIG. 19 is a top plan view of the head rail of FIG. 1, illustrating a preferred arrangement for the present spools for horizontal blinds and an alternative method of driving the lifting cord bobbins.

Those of skill in the art will appreciate that alternate configurations can be used to induce rotation of the lifting cord bobbins 48. For example, as illustrated in FIG. 19, rather than using a gear-driven system, the head rail 24 may include a belt-driven system. In this configuration, the first narrow portion 56 of the pull cord cylinder 54 is preferably rounded, as is the neighboring portion of each lifting cord bobbin 48. A belt 112 wraps around the rounded first narrow portion 56 of the pull cord cylinder 54, and around the adjacent rounded portion of one of the lifting cord bobbins 48. A second belt 112 similarly operatively connects the pull cord cylinder 54 to the second lifting cord bobbin 48. Friction between the belt 112 and the lifting cord bobbins 48 induces rotation of the lifting cord bobbins 48 as the pull cord cylinder 54 rotates. Those of skill in the art will appreciate that if more lifting cord bobbins 48 are used, then more belts 112 could be used to drive the additional lifting cord bobbins 48. For example, a belt 112 could be wrapped around adjacent lifting cord bobbins 48, such that one lifting cord bobbin 48 would drive the other.

Preferably, the pull cord gear 60 is larger than the lifting cord gears 62. The lifting cord spools 46 thus rotate more quickly than the pull cord spool 52. Those of skill in the art will appreciate that the gears 60, 62 need not be located at ends of the bobbins 48 and the pull cord spool 52. For example, the gears 60, 62 could be located at intermediate portions of the bobbins 48 and spool 52. Those of skill in the art will further appreciate that the pull cord cylinder 54 need not be located between the two lifting cord spool bobbins 48. For example, the two lifting cord spool bobbins 48 could be located to the same side of the pull cord cylinder 54.

Figure 6:
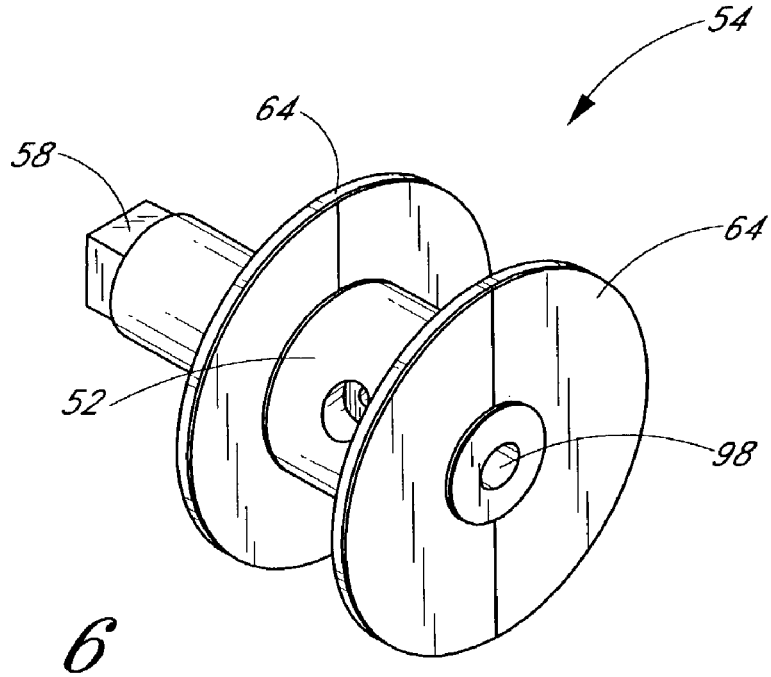
FIG. 6 is a perspective view of a pull cord cylinder including the present spools for horizontal blinds.
Figure 7:
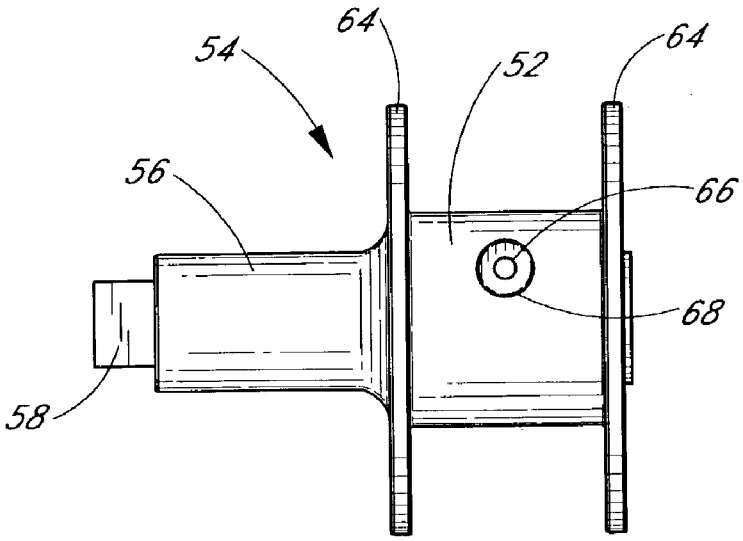
FIG. 7 is a front elevational view of the pull cord cylinder of FIG. 6.
Figure 10:
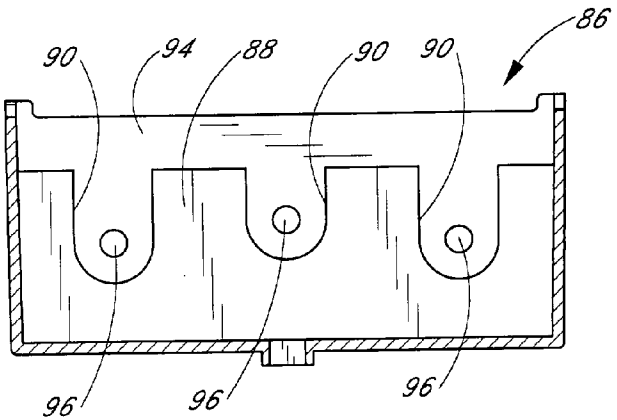
FIG. 10 is a front elevational, section view of the cradle of FIG. 8, taken along the line 10—10 of FIG. 9.
Figure 11:
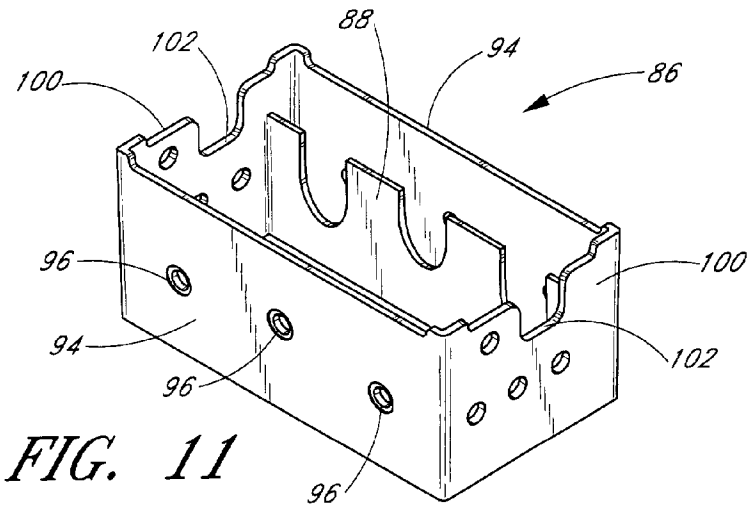
FIG. 11 is a front perspective view of the cradle of FIG. 8.
Figure 9:
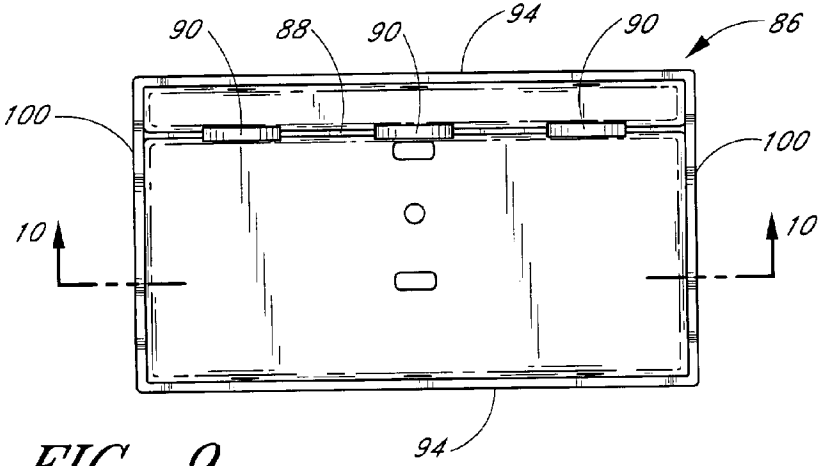
FIG. 9 is a top plan view of the cradle of FIG. 8.
Figure 8:
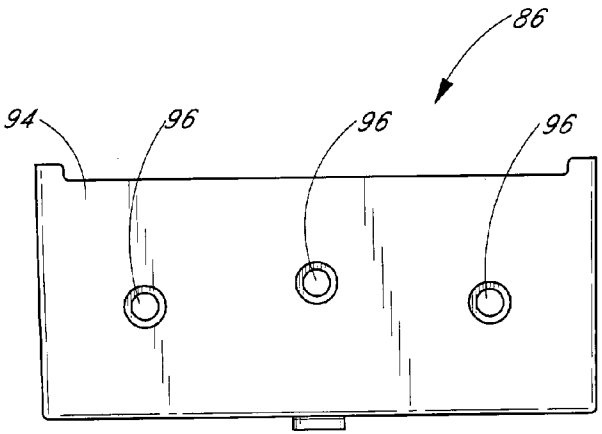
FIG. 8 is a front elevational view of a cradle adapted to rotatably support the present spools for horizontal blinds.
Figure 18:
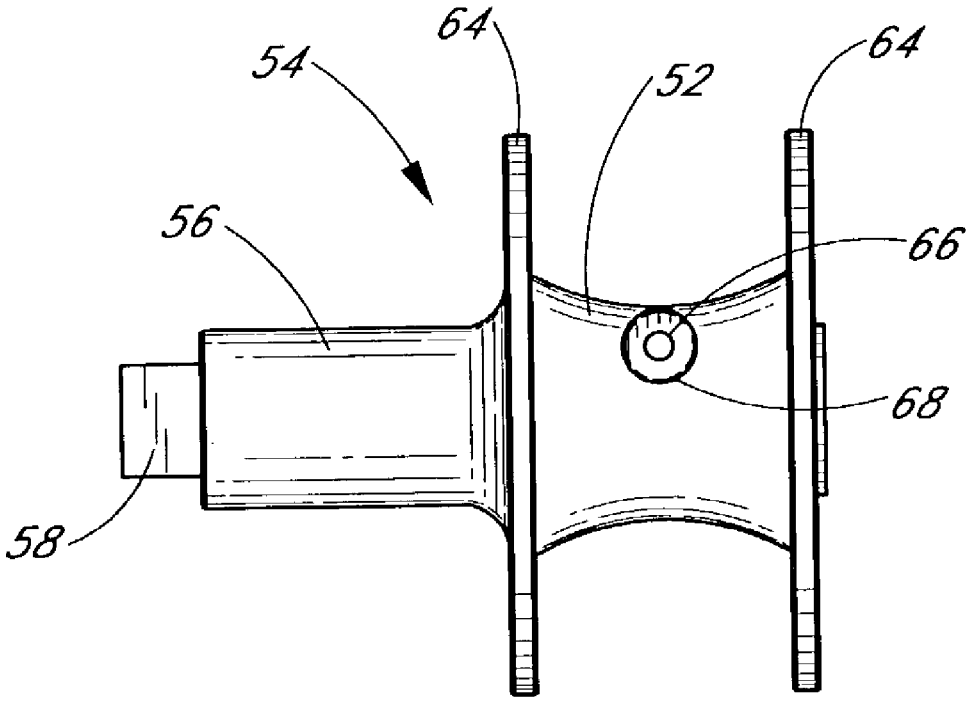
FIG. 18 is a front elevational view of an alternative embodiment of the pull cord cylinder.

The pull cord spool 52 comprises a second wider portion of the pull cord cylinder 54 bounded on either side by disk-shaped side walls 64 (FIGS. 6 and 7). In the illustrated embodiment, the portion of the pull cord spool 52 between the side walls 64 comprises a right cylinder. However, the portion could instead be tapered in a fashion similar to the lifting cord spools. An example of such a configuration is illustrated in FIG. 18.

The pull cord spool 52 includes a through-hole 66 defining an axis that is perpendicular to a longitudinal axis of the pull cord cylinder 54. In the illustrated embodiment, each end of the through-hole 66 is surrounded by a counter bore 68 of larger diameter than the through-hole 66. The through-hole 66 anchors the pull cord 50. When the blind assembly 20 is assembled, an assembly person threads the pull cord 50 through the hole 66 and ties a knot in the end of the pull cord 50. The knot (not shown) is sized such that it cannot pass through the hole 66, but is small enough to nest within the counter bore 68. Those of skill in the art will appreciate that the pull cord 50 could be anchored to the spool 52 using other methods besides the through-hole 66 and counter bore 68. For example, the end of the pull cord 50 could simply be glued to the spool 52.

As shown in FIGS. 2 and 3, the pull cord 50 extends from the pull cord spool 52, horizontally through the head rail 24, and downward through an aperture 72 in a lower surface of the head rail 24. A downward force on the hanging portion of the pull cord 50 rotates the pull cord spool 52, unwinding the pull cord 50 from the spool 52. Through interaction of the gears 60, 62, the rotation of the pull cord spool 52 induces rotation of the lifting cord spools 46, winding up the lifting cords 40 onto the lifting cord spools 46. As the lifting cords 40 wind up, their lower ends raise the bottom rail 28, which in turn raises each successive slat 22 from the bottom up. The gear ratio between the pull cord spool 52 and the lifting cord spools 46 enables the user to raise the slats 22 quickly. For every unit of distance that the pull cord 50 travels as the user pulls down, the lifting cords 40 rise a number of units equal to the gear ratio, which is preferably greater than one. The gear ratio thus preferably provides the user with a mechanical advantage, enabling quick raising and lowering of the slats 22. Those of skill in the art will appreciate that the gear ratio between the pull cord spool 52 and the lifting cord spools 46 could be varied to suit any particular application, including one in which the mechanical advantage provided is less than one (a mechanical disadvantage).

When the user releases the pull cord 50, gravity pulls the bottom rail 28 downward, winding up the pull cord 50 onto the pull cord spool 52, unwinding the lifting cords 40 from the lifting cord spools 46, and lowering the bottom rail 28 and slats 22. A brake 74 positioned within the head rail 24 engages the pull cord 50 at a user's direction.

When the brake 74 engages the pull cord 50, it prevents the pull cord 50 from winding onto the pull cord spool 52. Through interaction of the gears 60, 62, the brake 74 thus prevents the lifting cord spools 46 from turning under the influence of gravity acting on the bottom rail 28. The brake 74 thus enables the user to selectively control a height of the bottom rail 28.

The lifting cord spools 46, shown in detail in FIGS. 4 and 5, each comprise a substantially cylindrical bobbin 48 subdivided by substantially disk-shaped partitions 76. The bobbin 48 includes a central channel 78 that receives a cylindrical axle (not shown), as described below. A first end of each bobbin 48 includes a substantially square peg 80. A center of the peg 80 lies on the longitudinal axis of the bobbin 48. The peg 80 engages a substantially square aperture (not shown) in a center of the bobbin gear 62. The bobbin gear 62 thus rotates with the bobbin 48.

Each lifting cord spool 46, defined as the space between two neighboring partitions 76 on the lifting cord bobbin 48, comprises a flared cylindrical hub. When viewed in profile, as in FIG. 5, the narrowest circumference of each spool 46 is located at a center thereof. The circumference of each spool 46 increases in either direction away from the center, such that the largest circumference of each spool 46 is located at either side thereof, adjacent one of the partitions 76. In the illustrated embodiment, an arc defining the outer surface of each spool 46 traces a constant radius between the neighboring partitions 76. Those of skill in the art will appreciate that the arc need not have a constant radius. For example, the arc could trace a parabolic curve or an elliptical curve.

Each lifting cord spool 46 preferably includes a through-hole 82 defining an axis that is perpendicular to a longitudinal axis of the lifting cord bobbin 48. In the illustrated embodiment, each end of each through-hole 82 is surrounded by a counter bore 84 of larger diameter than the through-hole 82. The through-hole 82 anchors a lifting cord 40. When the blind assembly 20 is assembled, an assembly person threads a lifting cord 40 through the hole 82 and ties a knot in the end of the lifting cord 40. The knot (not shown) is sized such that it cannot pass through the hole 82, but is small enough to nest within the counter bore 84. Those of skill in the art will appreciate that the lifting cord 40 could be anchored to the spool 46 using other methods besides the through-hole 82 and counter bore 84. For example, the end of the lifting cord 40 could simply be glued to the spool 46.

The pull cord cylinder 54 and lifting cord bobbins 48 nest within a cradle 86, which is shown in detail in FIGS. 8–11. The cradle 86 comprises a substantially rectangular box with an open top. A partition wall 88 divides the interior of the cradle 86 into two unequally sized sections. The wall 88 includes three U-shaped indentations 90. The center indentation 90 supports the narrow portion 56 of the pull cord cylinder 54. Each indentation 90 to either side of the center indentation 90 supports a cylindrical portion 92 (FIG. 5) of one of the lifting cord bobbins 48. The cylindrical portion 92 is located between the peg 80 and the disk-shaped partition 76 nearest the peg 80. The gears 60, 62 are positioned within the smaller of the two sections of the cradle 86. End surfaces of the gears 60, 62 may abut surfaces of the partition wall 88 and the nearest parallel side wall 94. Preferably, these surfaces are flat so that the gears 60, 62 do not create noise, or chattering, as they rotate in contact with the wall surfaces.

Opposing first side walls 94 of the cradle 86 include three spaced holes 96. Each hole 96 corresponds to a hole 96 on the opposite wall 94, and each pair of holes 96 is aligned with one of the indentations 90 in the partition wall 88. An axle (not shown) extends between each pair of holes 96. The center axle passes through a central channel 98 (FIG. 6) in the pull cord cylinder 54, thereby rotatably supporting the pull cord cylinder 54. The axles to either side of the center axle each pass through the central channel 78 in one of the lifting cord bobbins 48, thereby rotatably supporting the lifting cord bobbins 48.

Those of skill in the art will appreciate that the cradle 86 need not include the partition wall 88. Each axle could be supported only at its ends by a pair of the spaced holes 96. Those of skill in the art will further appreciate that the pull cord cylinder 54 need not include the central channel 98, and the lifting cord bobbins 48 need not include the central channel 78. In such a configuration, the pull cord cylinder 54 and the lifting cord bobbins 48 would each preferably include a cylindrical peg (not shown) extending from either end thereof. The pegs would engage the pairs of space holes 96 to rotatably support the pull cord cylinder 54 and the lifting cord bobbins 48 within the cradle. The pegs could be formed as parts of a unitary whole with each of the pull cord cylinder 54 and the lifting cord bobbins 48, or they could be attached thereto.

Opposing second side walls 100 of the cradle 86 include indentations 102 in upper edges thereof. The indentations 102 provide clearance for the tilt rod 30, which passes through the cradle 86 in a direction perpendicular to the axles.

To raise the blinds in a blind assembly 20 including the present spools 46, 52, a user grasps the free-hanging portion of the pull cord 50 and applies a downward pulling force. The force disengages the brake 74 from the pull cord 50 and rotates the pull cord spool 52, unwinding the pull cord 50 from the pull cord spool 52. Rotation of the pull cord spool 52 induces rotation of the lifting cord bobbins 48 through interengagement of the pull cord gear 60 with the lifting cord gears 62. As the pull cord 50 unwinds from the pull cord spool 52, the lifting cords 40 wind onto the lifting cord spools 46.

The flared shape of each lifting cord spool 46 controls the winding pattern of each lifting cord 40. As the lifting cord 40 winds onto the spool 46, the flared, larger circumference portions urge the cord 40 toward the center of the spool 46. Thus, each lifting cord 40 winds first onto the narrow center portion of the spool 46. As the cord 40 winds further onto the spool 46, it gradually occupies a wider and wider span of the spool 46. The cord 40 forms well ordered layers on the spool 46, rather than bunching up in places and winding onto the spool 46 in a generally chaotic fashion. The well-ordered layers enable the cord 40 to unwind from the spool 46 in a smooth and orderly fashion, thus reducing the likelihood of the cord 40 becoming tangled with itself and preventing the blinds from lowering properly.

To lower the blinds in a blind assembly 20 including the present spools 46, 52, a user grasps the free-hanging portion of the pull cord 50 and first applies a downward pulling force. The force disengages the brake 74 from the pull cord 50. The user then lets gravity pull the bottom rail 28 downward while the pull cord 50 slides through the user's fingers. The descending bottom rail 28 unwinds the lifting cords 40 from the lifting cord spools 46. Interengagement of the gears 60, 62 causes the pull cord spool 52 to rotate and wind up the pull cord 50.

With the present spools, the lifting cords 40 unwind smoothly from the lifting cord spools 46 because they wind onto the spools 46 in the orderly fashion described above. With prior art spools, the lifting cords wind onto the spools in a random, jumbled fashion. Thus, the cords tend to bunch up, and bunches tend to trap later cord coils. Thus, as the user tries to lower the blinds, the lifting cord becomes trapped and tangled with itself, preventing the lifting cord from unwinding from the lifting cord spool, and preventing the bottom rail from descending.

Figure 15:
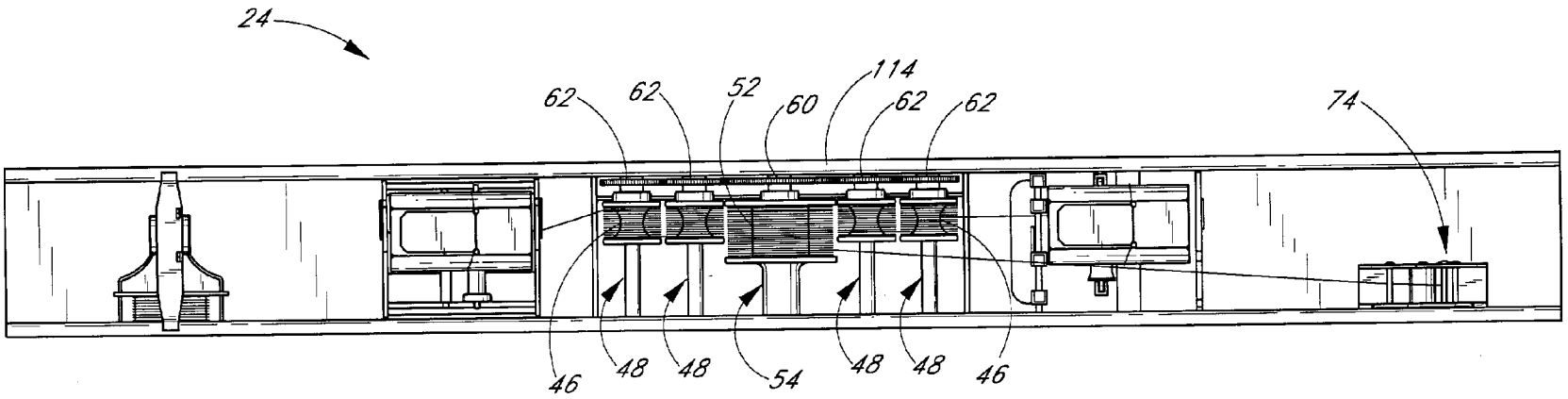
FIG. 15 is a top plan view of the head rail of FIG. 1, illustrating another preferred arrangement for the present spools for horizontal blinds.

Those of skill in the art will appreciate that each bobbin 48 could be partitioned into more or fewer spools 46, depending upon the requirements of any given application. For example, an alternative bobbin arrangement is illustrated in FIG. 15. In this arrangement, each bobbin 48 includes only one spool 46. In the illustrated embodiment, the spool 46 has the same width as the spools 46 shown in FIG. 3. However, those of skill in the art will appreciate that the spool 46 can be widened in order to increase the lifting cord capacity of the spool 46.

In the illustrated embodiment, each spool 46 is located adjacent a rear wall 114 of the head rail 24. Similarly, the pull cord spool 52 is located adjacent the rear wall 114. This configuration advantageously provides ample space in a front portion of the head rail 24 to house a tilt rod (not shown), such as the rod 30 shown in FIG. 2. Because the tilt rod is not located above the spools 46, 52, the spools 46, 52 can be made larger, or the head rail 24 can be made shorter, without creating any interference between the spools 46, 52 and the tilt rod. Those of skill in the art will appreciate that the spools 46, 52 could be located adjacent a front wall of the head rail 24, rather than the rear wall 114. Those of skill in the art will further appreciate that the spools 46, 52 need not all be located adjacent one of the walls. The spools 46, 52 could be staggered in a front-to-back direction within the head rail 24.

In the configuration illustrated in FIG. 15, a plurality of cord guides (not shown) could be used to properly position the cords 40 within the head rail 24. The cord guides would prevent the cords 40 from interfering with each other or with the components housed in the head rail 24. Those of skill in the art will appreciate that the cord guides are not necessary to the proper functioning of the present spools for horizontal blinds.

Figure 20:
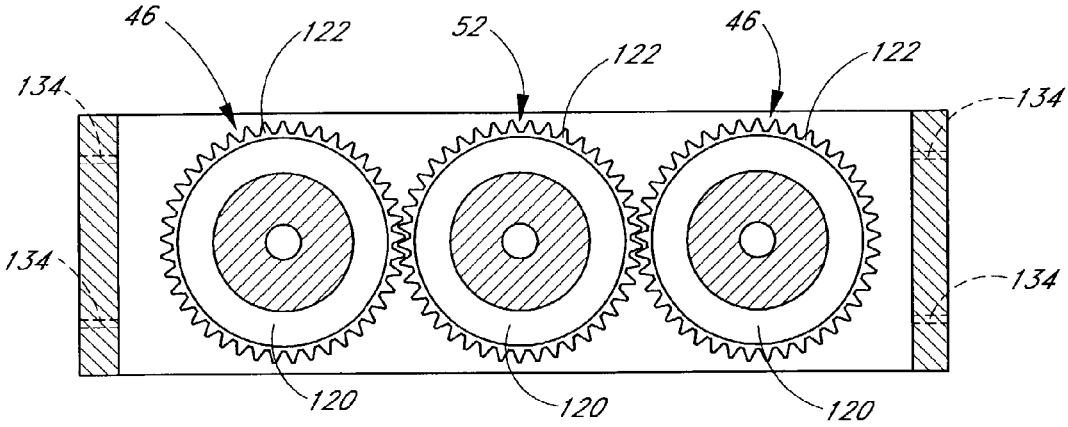
FIG. 20 is a cross-sectional front elevational view of an alternative apparatus for rotatably supporting the present spools for horizontal blinds, taken along the line 20—20 in FIG. 21.
Figure 21:
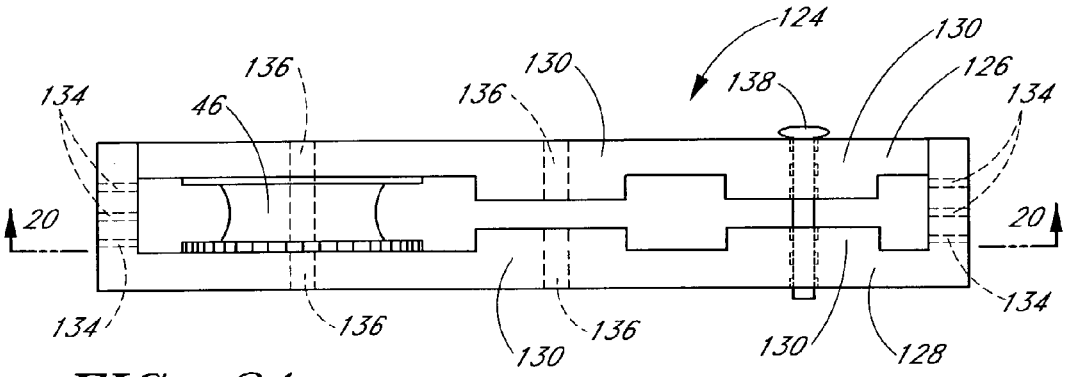
FIG. 21 is a top plan view of the apparatus of FIG. 20.
Figure 22:
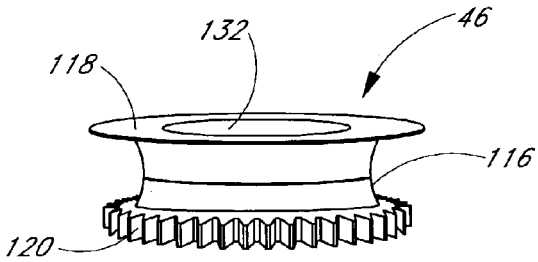
FIG. 22 is a top perspective view of an alternative embodiment of the present spools for horizontal blinds.

FIGS. 20 and 21 illustrate an alternative apparatus for rotatably supporting the spools 46, 52 in a configuration in which each spool 46, 52 is located side-by-side adjacent a front or rear wall of the head rail 24. As shown in FIG. 22, each spool 46 includes a tapered cylindrical portion 116 in which a cord (not shown) is wound. A side wall 118 encloses a first side of the cylindrical portion 116. An integral gear 120 encloses a second side of the cylindrical portion 116.

As shown in FIG. 20, which is a front elevational view, each spool 46, 52 is located at the same height. Those of skill in the art will appreciate that the spools 46, 52 could be located at different heights. The teeth 122 of each gear 120 engage the gear teeth 122 on the adjacent spool 46, 52, such that the pull cord spool 52 induces rotation of the lifting cord spools 46, and vice versa, as described above. Those of skill in the art will appreciate that the spools 46, 52 need not include gears 120. The spools 46, 52 could, for example, be driven by a belt system, as described above.

As shown in FIG. 21, which is a top plan view, the spool support apparatus 124 comprises a first plate 126 and a second plate 128. In FIG. 21 only one spool 46 is shown in order to illustrate the manner in which the spools 46, 52 are supported. Each plate 126, 128 includes a plurality of disk-shaped bosses 130, and the bosses 130 on the first plate 126 align with the bosses 130 on the second plate 128. Opposite side faces of each spool 46 include a disk-shaped cavity 132 (FIG. 22) having a diameter slightly larger than that of the bosses 130. The spool cavities 132 mate with a pair of aligned bosses 130, such that each spool 46, 52 is rotatably supported by one pair of aligned bosses 130.

The plates 126, 128 may include one or more apertures 136 that are concentric with the bosses 130. The apertures 136 may accept fasteners such as a bolt 138, illustrated in FIG. 21. The fasteners may be used to hold the plates 126, 128 together. Alternatively, the plates 126, 128 may be secured to one another with adhesive. Fasteners may also cooperate with the apertures 136 to secure the apparatus 124 to the head rail 24.

Ends of the plates 126, 128 include apertures 134 through which the cords pass. The plates 126, 128 may be secured within the head rail 24 such that the axes of each spool 46, 52 are horizontal, similar to the configuration of FIG. 15. In this configuration, the plates 126, 128 may be secured to either a front or a rear wall of the head rail 24. Alternatively, the plates 126, 128 may be secured within the head rail 24 such that the axes of each spool 46, 52 are vertical. In either configuration, the flat configuration of the plates 126, 128 creates ample room within the head rail to house other components, such as a tilt rod (not shown). The flat plates 126, 128 thus enable the head rail to be designed more compactly, as described above.

Figure 16:
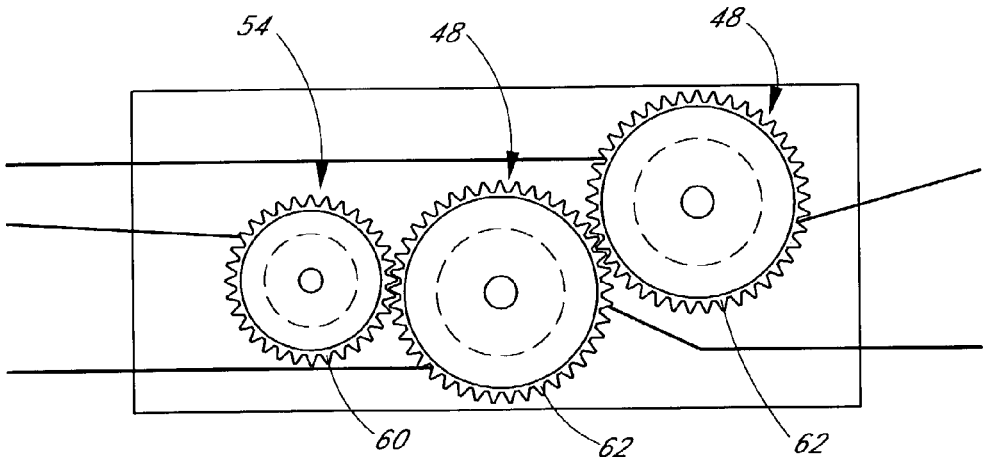
FIG. 16 is a front elevational view of a preferred arrangement for the present spools for horizontal blinds.
Figure 17:
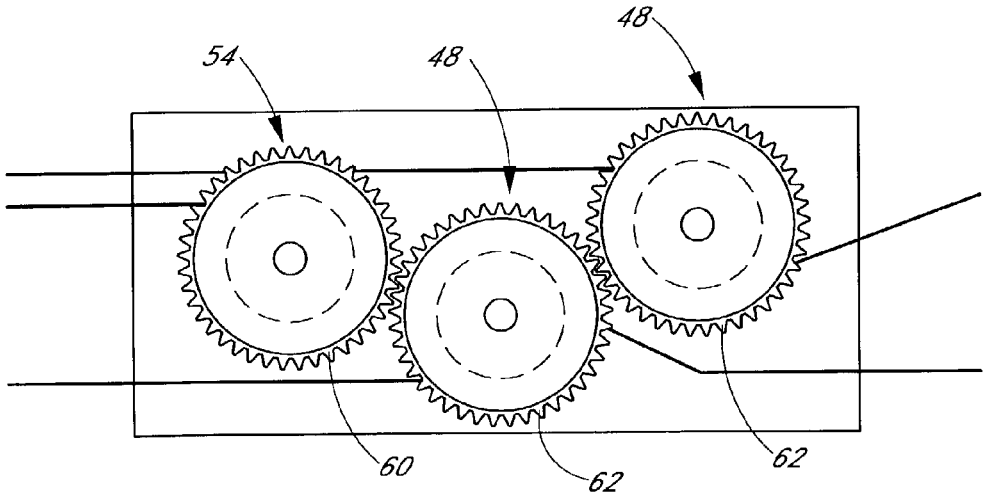
FIG. 17 is a front elevational view of another preferred arrangement for the present spools for horizontal blinds.

In the embodiment illustrated in FIG. 15, four bobbins 48 are provided, and each is arranged side-by-side with a pull cord spool 52 located between the bobbins 48, such that two bobbins 48 are located to either side of the pull cord spool 52. In this arrangement, longitudinal axes of the bobbins 48 are preferably located at different heights in order to prevent the lifting cords 40 from interfering with one another. FIGS. 16 and 17 illustrate, in schematic front elevational views, examples of preferred arrangements of the bobbins 48 and the lifting cord spool 52. Those of skill in the art will appreciate that the axes need not be located at different heights. An alternative method of preventing the lifting cords 40 from interfering with one another is to stagger the position of each spool 46 along its respective bobbin 48 as measured in a front-to-back direction along the head rail 24.

Figure 12:
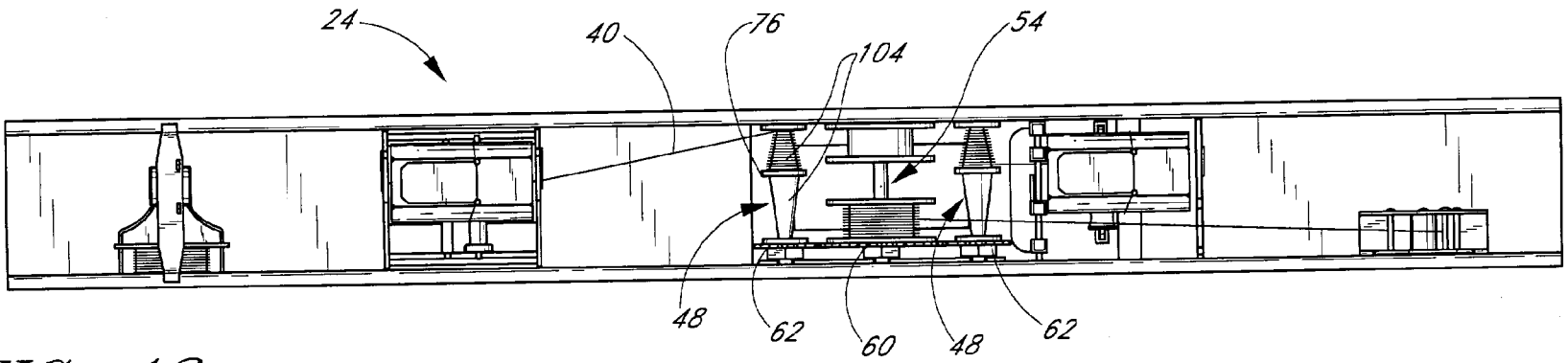
FIG. 12 is a top plan view of a head rail including an alternative embodiment of the present spools for horizontal blinds.

FIG. 12 illustrates another preferred embodiment of the present spools for horizontal blinds. As in the embodiment described above, the head rail 24 includes two lifting cord bobbins 48, one positioned on either side of a pull cord cylinder 54. The pull cord cylinder 54 is operatively connected to the lifting cord bobbins 48 through gears 60, 62 secured at a first end of each component. Each lifting cord bobbin 48 is subdivided into two lifting cord spools 104 by a disk-shaped partition 76. In the illustrated embodiment, the lifting cord spools 104 are of unequal size. Those of skill in the art will appreciate that the lifting cord spools 104 could be of equal size.

In the illustrated embodiment, the lifting cord spools 104 are shaped as linearly tapered cylinders. As the lifting cords 40 wind onto the lifting cord spools 104, they tend to wind first onto the narrow end of each spool 104. The lifting cords 40 gradually travel toward the wide end of each spool 104 as they wind further and further onto the lifting cord spools 104. Because each lifting cord 40 winds onto the spools 104 in such a predictable fashion, any tendency of each lifting cord 40 to become entangled with itself is virtually eliminated. The lifting cords 40 unwind smoothly from the spools 104, enabling the bottom rail 28 to descend smoothly as the blinds are lowered.

Figure 13:
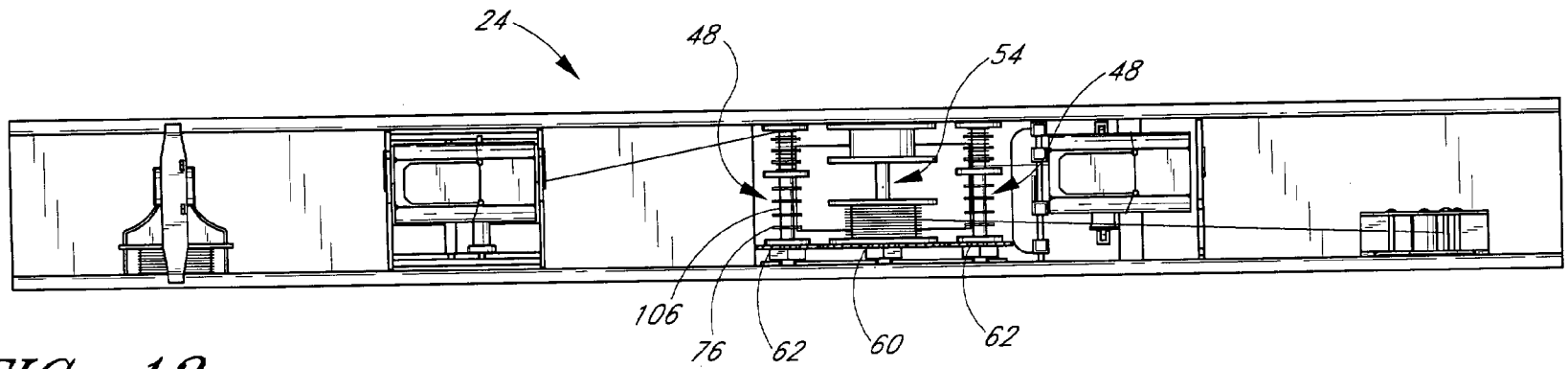
FIG. 13 is a top plan view of a head rail including an alternative embodiment of the present spools for horizontal blinds.

FIG. 13 illustrates another preferred embodiment of the present spools for horizontal blinds. In this embodiment, the lifting cord spools 106 are shaped as square cylinders, but include a plurality of spaced disk-shaped partitions 76. As the lifting cords 40 wind onto the lifting cord spools 106, they tend to wind first onto one of the spaces between two partitions 76. When that space fills, the cord 40 then jumps over the disk-shaped partition 76 into the adjacent space. The cord 40 then fills that space before jumping over into the next space, and so on. As with the previous embodiments, the lifting cords 40 wind onto the spools 106 in a predictable fashion, thus reducing any tendency of each lifting cord 40 to become entangled with itself. The lifting cords 40 unwind smoothly from the spools 106, enabling the bottom rail 28 to descend smoothly as the blinds are lowered.

Figure 14:
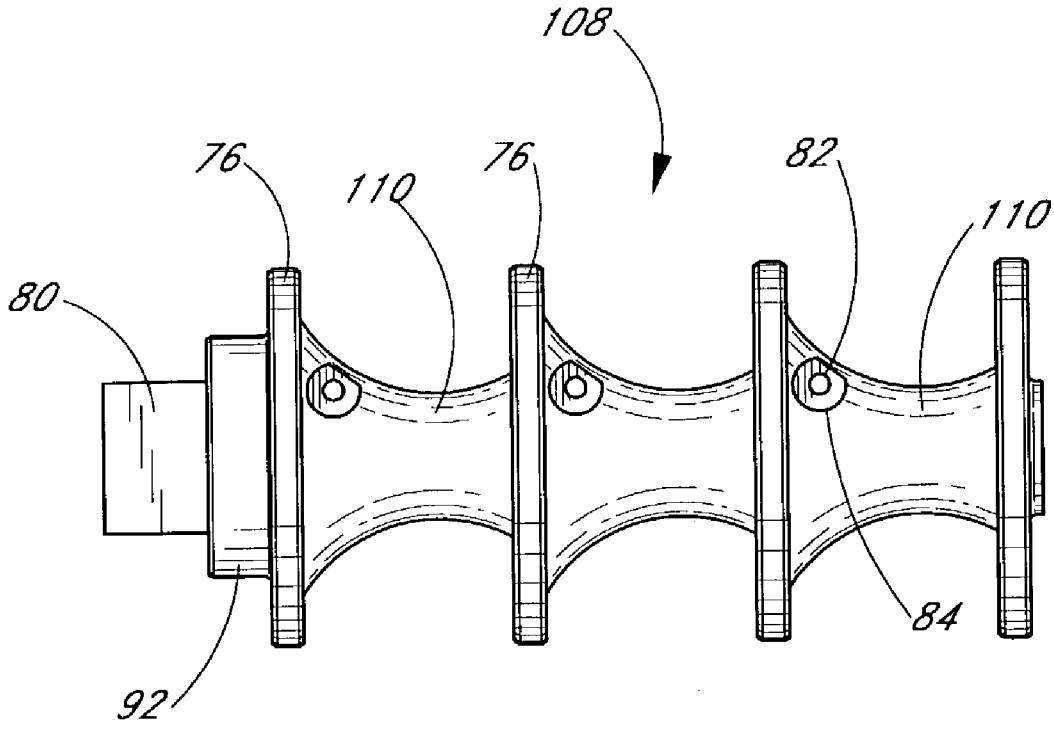
FIG. 14 is a front elevational view of an alternative embodiment of the lifting cord bobbin.

FIG. 14 illustrates a lifting cord bobbin 108 having lifting cord spools 110 with an asymmetrical shape. Each of these alternate spools 110 includes large, but unequal, circumferences at locations adjacent the disk-shaped partitions 76. Each large circumference tapers to a minimum circumference that is located intermediate, but not at a midpoint between, the disk-shaped partitions 76. An arc defining the outer surface of each alternate spool 110 may trace a constant radius between the neighboring partitions 76, as shown. Alternatively, the arc may trace a variable radius. For example, the arc could trace a parabolic curve or an elliptical curve. The lifting cords 40 wind onto and unwind from the alternate spools 110 in the same smooth and orderly fashion described above with respect to the spools 46.

SCOPE OF THE INVENTION

The above presents a description of the best mode contemplated for carrying out the present spools for horizontal blinds, and of the manner and process of making and using them, in such full, clear, concise, and exact terms as to enable any person skilled in the art to which they pertain to make and use these spools. These spools are, however, susceptible to modifications and alternate constructions from that discussed above that are fully equivalent. Consequently, these spools are not limited to the particular embodiments disclosed. On the contrary, these spools cover all modifications and alternate constructions coming within the spirit and scope of the spools as generally expressed by the following claims, which particularly point out and distinctly claim the subject matter of the spools.

What is claimed is:

1. A horizontal blind assembly, comprising:

a head rail configured for housing components of the assembly;

at least a first lifting cord spool rotatably mounted within the head rail, the lifting cord spool defining a first axis of rotation;

at least a first lifting cord, a portion of the lifting cord being wound around the lifting cord spool such that the lifting cord extends at least once around the circumference of the lifting cord spool;

at least a first pull cord spool rotatably mounted within the head rail, the pull cord spool defining a second axis of rotation that is spaced from the first axis of rotation, the pull cord spool being operably coupled to the lifting cord spool such that rotation of either spool induces rotation of the other spool; and at least a first pull cord, wherein a portion of the pull cord is wound around the pull cord spool, and a remaining portion of the pull cord extends through at least a portion of the head rail and downward out of the head rail.

2. The horizontal blind assembly of claim 1, wherein the pull cord spool comprises first and second spaced, substantially disk-shaped walls, and a flared cylinder spanning the space between the walls.

3. The horizontal blind assembly of claim 1, wherein the cylinder includes a minimum circumference at substantially a center thereof, as measured along a longitudinal axis thereof, and the cylinder includes maximum circumferences at portions thereof that adjoin the walls, and a surface of the cylinder defines a smooth curve between opposing points on the walls.

4. The horizontal blind assembly of claim 1, wherein the lifting cord spool includes a first gear that rotates with the lifting cord spool, and the pull cord spool includes a second gear that rotates with the pull cord spool.

5. The horizontal blind assembly of claim 4, wherein the gears intermesh to rotatably couple the lifting cord spool to the pull cord spool.

6. The horizontal blind assembly of claim 5, wherein a downward pulling force applied to the pull cord induces rotation of the pull cord spool, thereby unwinding the pull cord from the pull cord spool, and induces rotation of the lifting cord spool, thereby winding the lifting cord onto the lifting cord spool.

7. The horizontal blind assembly of claim 4, wherein the second gear is larger in diameter than the first gear, thereby defining a gear ratio greater than one.

8. The horizontal blind assembly of claim 1, further comprising a belt that extends around the lifting cord spool and the pull cord spool, thereby rotatably coupling the lifting cord spool to the pull cord spool.

9. The horizontal blind assembly of claim 1, further comprising at least a first ladder extending downward from the head rail.

10. The horizontal blind assembly of claim 9, further comprising a plurality of slats suspended from the head rail by the ladder.

11. The horizontal blind assembly of claim 9, further comprising a bottom rail suspended from the head rail by the ladder.

* * * * *